US007354133B2

(12) United States Patent
Ide et al.

(10) Patent No.: US 7,354,133 B2
(45) Date of Patent: Apr. 8, 2008

(54) INK JET RECORDING APPARATUS AND MAINTENANCE METHOD THEREOF

(75) Inventors: Daisaku Ide, Tokyo (JP); Hiroshi Tajika, Kanagawa-ken (JP); Hitoshi Nishikori, Tokyo (JP); Takeshi Yazawa, Kanagawa-ken (JP); Atsuhiko Masuyama, Tokyo (JP); Akiko Maru, Kanagawa-ken (JP); Hirokazu Yoshikawa, Kanagawa-ken (JP); Hideaki Takamiya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 11/045,108

(22) Filed: Jan. 31, 2005

(65) Prior Publication Data

US 2005/0174380 A1 Aug. 11, 2005

(30) Foreign Application Priority Data

Feb. 6, 2004 (JP) ..... 2004-030830

(51) Int. Cl.
*B41J 2/165* (2006.01)

(52) U.S. Cl. ..... 347/23; 347/29; 347/30; 347/33; 347/35

(58) Field of Classification Search ..... 347/20, 347/22–35, 49
See application file for complete search history.

(56) References Cited

U.S. PATENT DOCUMENTS

| | | | | |
|---|---|---|---|---|
| 5,625,384 | A | | 4/1997 | Numata et al. |
| 6,024,430 | A | | 2/2000 | Koitabashi et al. |
| 6,050,669 | A | * | 4/2000 | Yano et al. ..... 347/23 |
| 6,142,600 | A | | 11/2000 | Takahashi et al. |
| 6,145,950 | A | | 11/2000 | Ohtsuka et al. |

FOREIGN PATENT DOCUMENTS

| | | |
|---|---|---|
| JP | 3176343 | 4/2001 |

* cited by examiner

*Primary Examiner*—Shih-Wen Hsieh
(74) *Attorney, Agent, or Firm*—Fitzpatrick, Cella, Harper & Scinto

(57) ABSTRACT

The invention provides a configuration capable of judging whether an ink jet head is exchanged or whether it is replaced, and changing an amount of recovery operation when the ink jet head is exchanged or replaced. Thus a recording apparatus capable of avoiding a defective ink supply in case the ink jet head is exchanged or replaced, and not wasting the ink by unnecessarily excessive recovery operation, can be provided.

2 Claims, 11 Drawing Sheets

INK JET RECORDING APPARATUS AND MAINTENANCE METHOD THEREOF

BACKGROUND OF THE INVENTION

1. Field of the Invention

The present invention relates to an ink jet recording apparatus capable of a high-quality recording, and more particularly to a recording apparatus having an exchangeable ink jet head and a recovery control method (maintenance method) therefor.

2. Related Background Art

An ink jet recording apparatus is widely employed in a printer, a copying apparatus and the like for reasons of e.g. a low noise, a low running cost and an easy compact formation of the apparatus. In such ink jet recording apparatus, foreign substances such as unnecessary ink droplets and paper dusts may be deposited in the vicinity of discharge ports by fine ink droplets generated in addition to a main ink droplet when ink is discharged or by rebound of the ink droplet landing on a recording medium. Such deposition of the foreign substances may result in a deviation of an ink discharging direction or a landing position, an ink discharge failure or a deterioration of the image quality.

As the ink jet recording apparatus is a system for converting input image data into an output image by way of a liquid constituting the ink, a maintenance technology for achieving satisfactory ink droplet discharge is a very important factor. In the following, there will be briefly described principal phenomena requiring the maintenance (recovery operation).

(a) In the course of recording of input image data, among plural discharge ports provided in an ink jet head, ink evaporates in a non-discharging discharge port, whereby the ink in the discharge port becomes viscous and cannot be discharged stably with an ordinary discharge energy, thereby resulting in a discharge failure;

(b) In the recording, the ink droplet discharged from a nozzle includes a main ink droplet and fine droplets (called mist), which are deposited around the ink discharge port of the ink jet head, thereby hindering straightness of the ink discharge; and (c) In case a bubble is present in an ink reservoir in the ink jet head, a gas penetrating through a material constituting the ink jet head is taken into such bubble to cause a growth of the bubble, which is inflated at a temperature elevation in the printing operation, thereby hindering an ink supply from an ink tank and eventually resulting in a defective printing.

For solving such phenomena, following maintenance technologies are known.

(a) According to a time or an environment in which the ink discharge is not executed, a discharge of a predetermined amount is executed separately from the printing operation for forming an image on a recording medium, thereby discharging the viscosified ink (hereinafter this operation being called a preliminary discharge).

(b) A number of discharges of the ink droplet from the discharge port is counted, and, when the count exceeds a predetermined number, a surface of the ink jet head on which the discharge ports are formed (hereinafter such surface being called a face) is wiped with a rubber blade or the like to remove the deposited ink (hereinafter such operation being called a wiping).

(c) A recovery operation is executed by sucking the ink from the discharge port by a pump, thereby discharging the ink in the discharge port (hereinafter such operation being called suction recovery).

Also in an ink jet recording apparatus in which the ink jet head and the ink tank are mutually separable and the ink tank is exchangeable, the suction recovery is executed also after the exchanging of the ink tank.

Now, the wiping operation and the suction recovery operation will be explained briefly with reference to the accompanying drawings.

FIG. 1 explains the wiping operation. There are shown a rubber blade 1101 for wiping, a face 1102 to be wiped, an ink discharge port 1103, a deposited ink 1104 to hinder the discharge, and a wiping direction 1105. In the wiping, the rubber blade 1101 pressed to the ink jet head as illustrated is moved in a direction 1105 thereby bringing the deposited ink 1104 in contact with the blade and wiping it off from the face.

FIG. 2 is a view explaining the suction recovery. There are shown an ink jet head 1201, an ink discharge nozzle 1202, a face 1203, a suction cap 1204, an ink discharge tube 1205, and a suction pump 1206 for generating a negative pressure for sucking the ink. The suction recovery operation is executed by contacting or sealingly pressing a generally rubber suction cap 1204 to the face 1203 and rotating the suction pump 1206 in a direction indicated by an arrow 1207 to generate a negative pressure thereby sucking the ink in the ink jet head 1201 from the ink discharge port 1202 into the suction cap 1204 and discharging it through the ink discharge tube 5.

In the recent ink jet recording apparatus for which a higher image quality and a higher speed are required, kinds of loaded inks and number of the ink discharging ports are drastically increased in comparison with those in several years ago, and such maintenance technologies are becoming a large issue.

Also for a lower cost and a higher recording quality of the recording apparatus, there is proposed an ink jet head cartridge in which an ink jet head portion and an ink tank portion are constructed integrally and which is rendered exchangeable on the recording apparatus. In the ink jet head of such type, in case the user makes a selection among the plural ink jet head cartridges different in the types or colors of the inks for mounting on the recording apparatus, there is conceived a case where the main body of the recording apparatus and cartridge (type of ink in the ink jet head cartridge) cannot be matched and a maintenance suitable for the ink jet head cartridge (type of ink in the ink jet head cartridge) cannot be executed. It is therefore proposed to provide the ink jet head cartridge with a semiconductor memory storing characteristics of the ink jet head cartridge such as the type of the ink and the number of the discharge ports.

Also in the aforementioned exchangeable ink jet head, being integral with the ink tank, may show a deterioration in the characteristics of the ink jet head by a shock in transportation or an environmental change. Therefore, at an exchange to a new ink jet head, the recording apparatus has to execute a recovery operation for filling the ink jet head with the ink thereby refreshing the ink jet head.

Thus, in order to improve the operability at the exchange of the ink jet head and to achieve an optimum recording after the exchange of the ink jet head, Japanese Patent No. 3176343 (patent reference 1) describes a technology of executing a recovery operation of a larger amount for an ink jet head that has been judged as exchanged, than that for an ink jet that has been judged as not exchanged.

A method for detecting the ink jet head exchange described in the patent reference 1 reads a serial number attached to the ink jet head and judges that the ink jet head has not been exchanged in case the read serial number is same as a serial number read previously, and that ink jet head has been exchanged in case the read serial number is different from a serial number read previously (cf. FIG. 3). Also the recovery operation is so controlled that a recovery amount becomes larger in a case where the ink jet head is exchanged than in a case where the ink jet head is not exchanged (cf. FIG. 4).

On the other hand, in a recording apparatus of a configuration in which the ink tank and the ink jet head are separable and the ink tank has to be detached from the recording apparatus in case of detaching the ink jet head from the recording apparatus, since the ink tank also is detached at the detaching of the ink jet head, whereby a joint portion between the ink tank and the ink jet head is exposed to the air to cause an evaporation of the ink from such joint portion, and there is concerned a defective ink supply at the joint portion between the ink tank and the ink jet head in a mounted state. Also in case the detached ink jet head is handled improperly or roughly, there may be caused an ink leakage from the joint portion or from the nozzles, thereby leading to a defective ink supply in the joint portion or in the ink jet head.

Thus, in case the ink jet head is detached and mounted without the exchange of the ink jet head, a suction recovery is necessary in order not to cause a defective ink supply. However, in case the ink jet head is not exchanged but merely detached and replaced, a recovery operation of a level at the exchange of the ink jet head is not required since the ink has been supplied in the head prior to the detachment of the ink jet head.

However, the technology described in the patent reference can detect the exchange of the ink jet head but cannot detect the detaching and mounting thereof, so that, in case the ink jet head is judged as not exchanged, the recovery operation is not executed until an uncapped period or a time elapsing from the previous suction operation exceeds a threshold value, whereby a defective ink supply may occur in case the ink jet head is detached and mounted.

In case a recovery operation is always executed even in case the ink jet head is judged as not exchanged in order to the reduce the defective ink supply caused by the detaching and mounting of the ink jet head, the recovery operation is conducted even in case the detachment and mounting of the ink jet head is not executed and thus the recovery operation is not necessary, so that the ink amount consumed in the recovery operation is elevated thereby leading to drawbacks of an elevated running cost, and a large used ink absorbent member is required for absorbing the used ink, thereby leading to an increased dimension of the recording apparatus.

SUMMARY OF THE INVENTION

An object of the present invention is to provide an ink jet recording apparatus that does not cause a defective ink supply at the exchange or the detaching and mounting of the ink jet head, and that reduces a waste ink consumption resulting from unnecessarily many recovery operations, thereby enabling an appropriate recovery operation.

The invention provides an ink jet recording apparatus in which plural ink jet heads for discharging inks are selectably mountable on a carriage and a recording is executed by a scanning motion of the carriage, including recovery means which maintains a satisfactory ink discharge state from the ink jet head, detection means which detects whether the ink jet head is mounted on the carriage, judgment means which discriminates whether the ink jet head newly mounted on the carriage is same as or different from a previously mounted ink jet head, and recovery control means which controls a recovery operation for the ink jet head by the recovery means according to a result of the detection means and the judgment means, wherein the recovery control means differentiates a recovery operation in case the newly mounted ink jet head is same as the previously mounted ink jet head and a recovery operation in case the newly mounted ink jet head is different from the previously mounted ink jet head.

The invention also provides an ink jet recording apparatus in which plural ink jet heads for discharging inks are selectably mountable on a carriage and a recording is executed by a scanning motion of the carriage, including recovery means which maintains a satisfactory ink discharge state from the ink jet head, detection means which detects whether the ink jet head is mounted on the carriage, judgment means which discriminates whether the ink jet head newly mounted on the carriage is same as or different from a previously mounted ink jet head, and recovery control means which controls a recovery operation for the ink jet head by the recovery means according to a result of the detection means and the judgment means, wherein the recovery control means differentiates a recovery operation in case the newly mounted ink jet head is same as the previously mounted ink jet head and a recovery operation in case the ink jet head is not detached from the carriage.

The invention also provides a recovery control method for an ink jet recording apparatus in which plural ink jet heads for discharging inks are selectably mountable on a carriage, recovery means is provided for maintaining a satisfactory ink discharge state from the ink jet head and a recording is executed by a scanning motion of the carriage, the method including a detection step of detecting whether the ink jet head is mounted on a carriage, a judgment step, in case a new mounting of the ink jet head on the carriage by the detection step, of judging whether the ink jet head newly mounted on the carriage is different from a previously mounted ink jet head, and a recovery control step of controlling a recovery operation by the recovery means according to a result of the judgment step, wherein the recovery control step differentiates a recovery operation in case the newly mounted ink jet head is same as the previously mounted ink jet head and a recovery operation in case the newly mounted ink jet head is different from the previously mounted ink jet head.

The present invention executes recovery operations of different recovery amounts respectively when an exchange or a detaching and replacing of the ink jet head is detected, thereby avoiding a defective ink supply and also reducing a wasted consumption of the ink by unnecessarily many recovery operations.

DESCRIPTION OF THE PREFERRED EMBODIMENTS

In the following, an embodiment of the present invention will be explained with reference to the accompanying drawings.

(Ink Jet Recording Apparatus)

(Description of the Structure)

At first, there will be explained configuration of mechanisms in the recording apparatus employed in the present embodiment. A main body of the recording apparatus in the present embodiment can be classified, by functions, into a sheet feeding portion, a sheet conveying portion, a sheet discharge portion, a carriage portion, a cleaning portion and an external casing portion.

Figure 1:
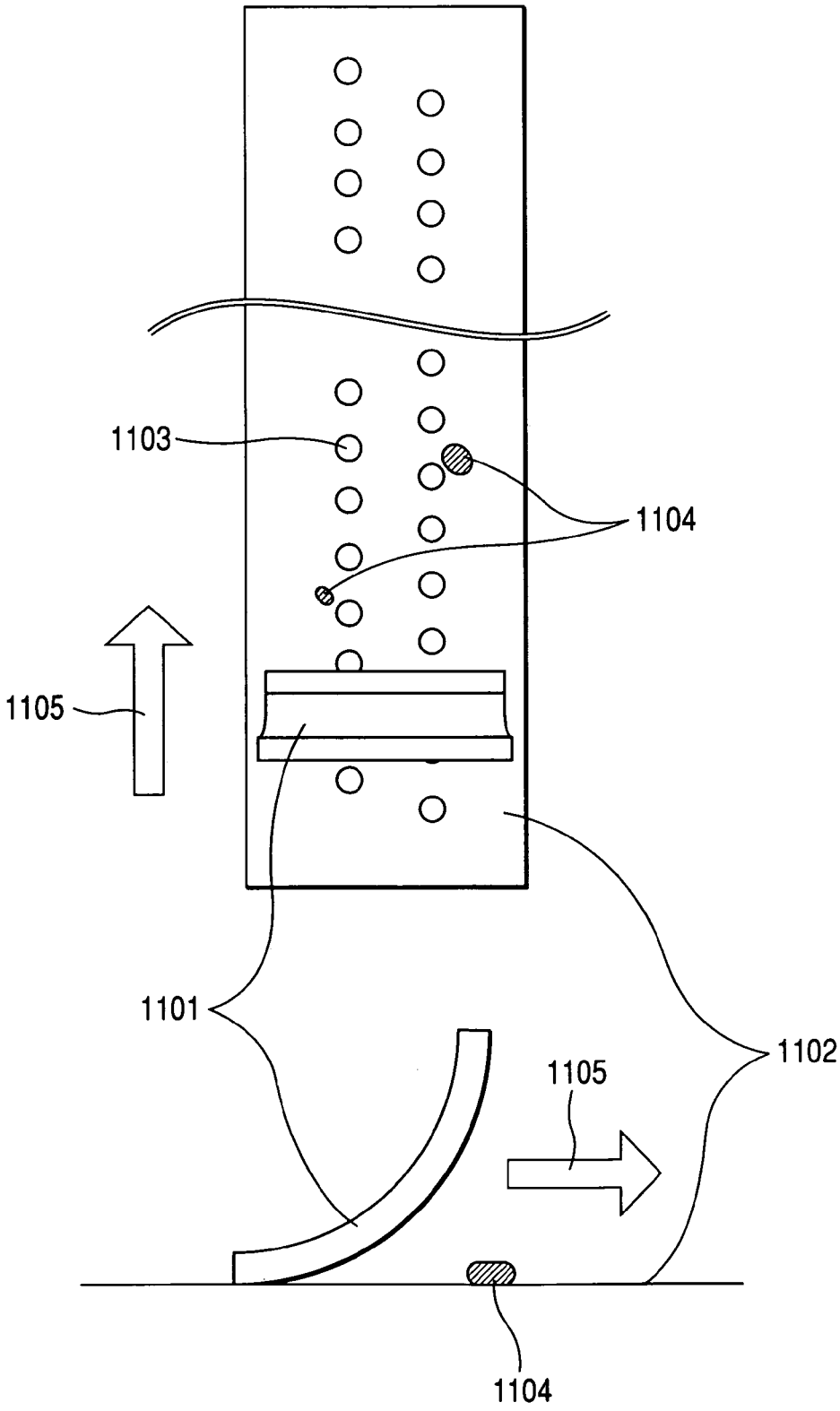
FIG. 1 is a view showing a wiping operation.
Figure 2:
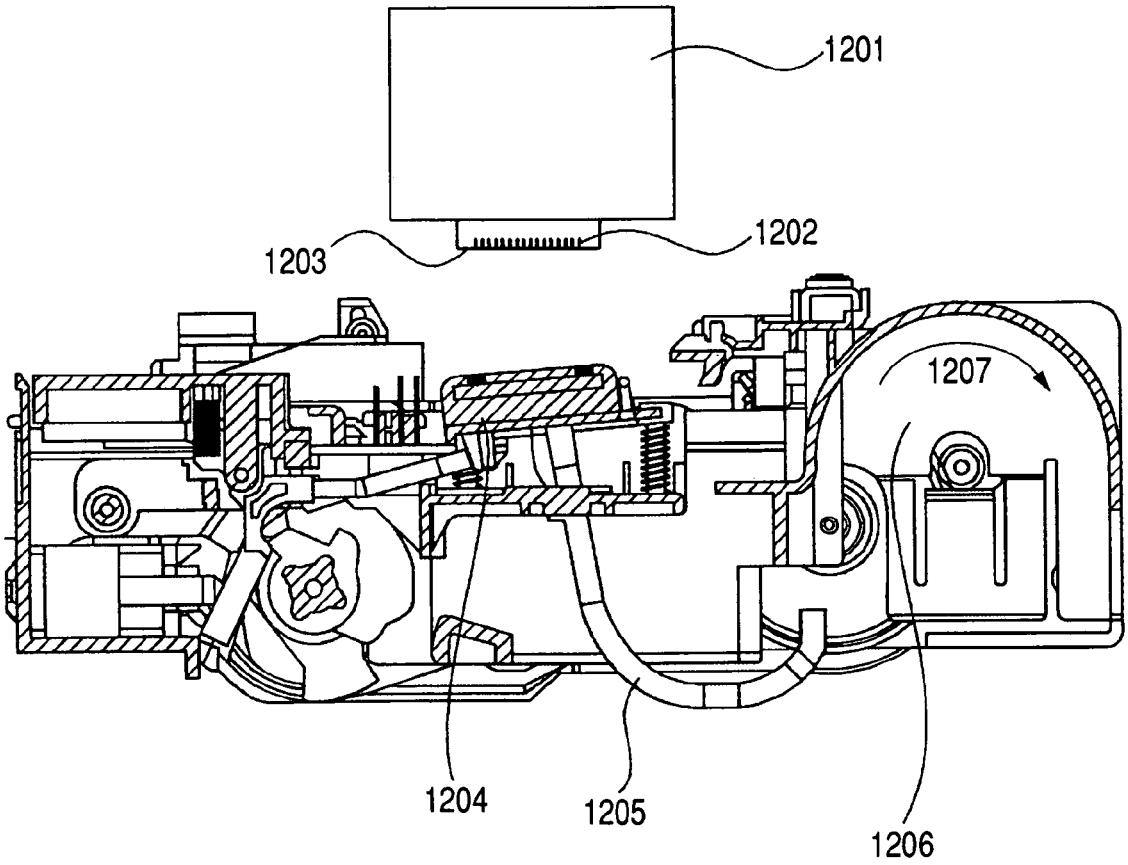
FIG. 2 is a view showing a suction recovery operation.
Figure 3:
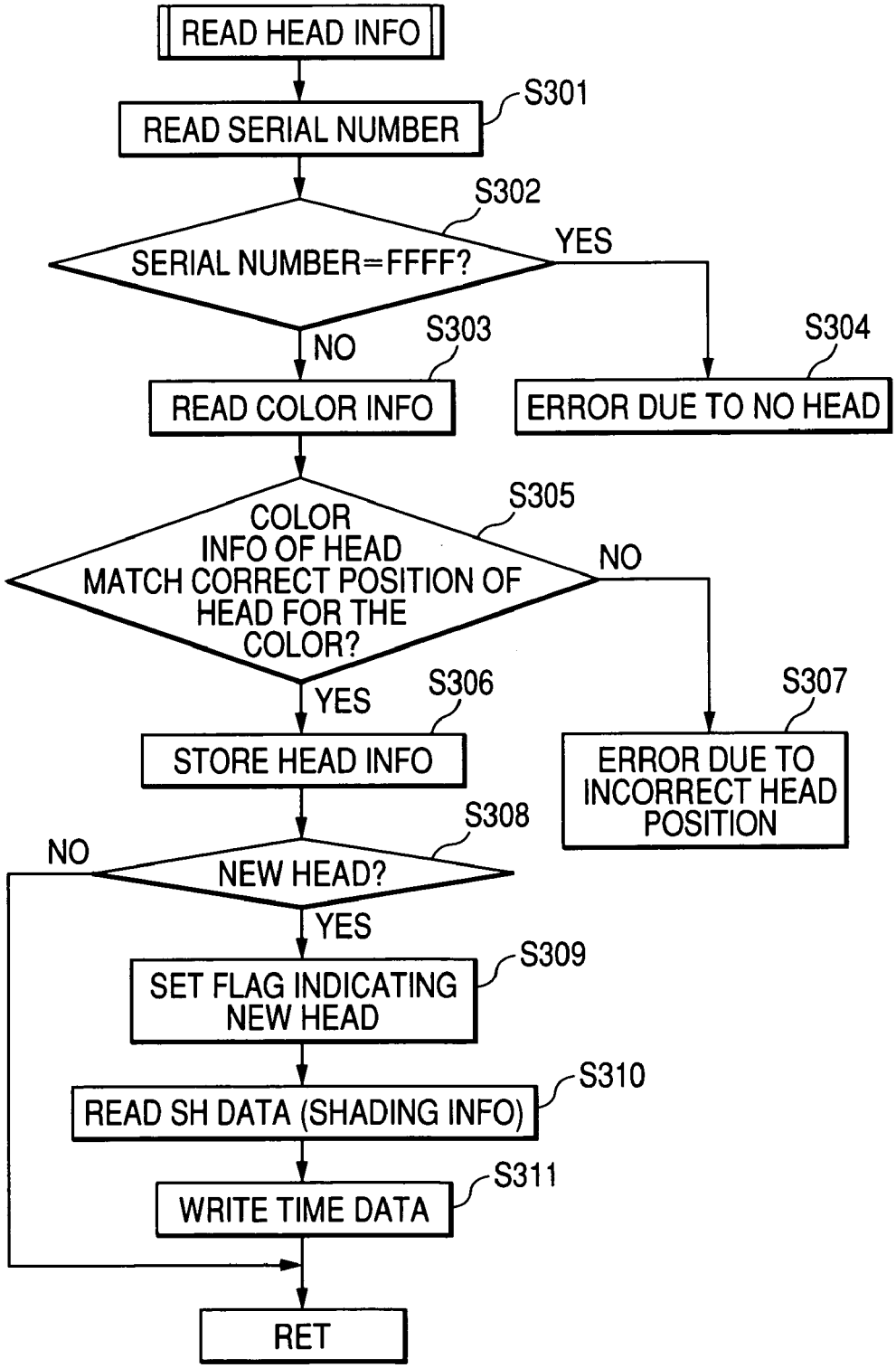
FIG. 3 is a flow chart showing details of an ink jet head information reading routine.
Figure 4:
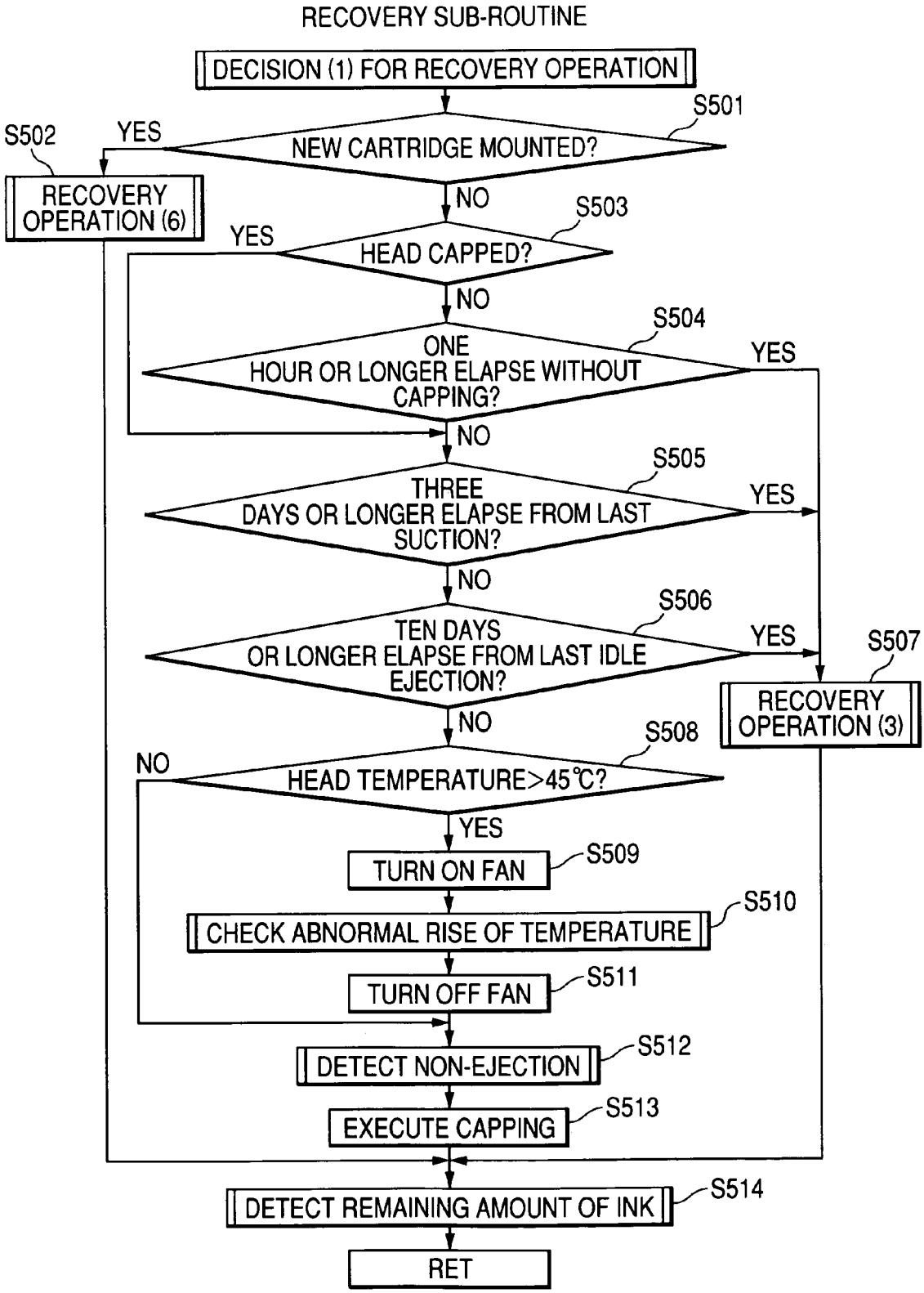
FIG. 4 is a flow chart showing details of a recovery operation judging reading routine.
Figure 5:
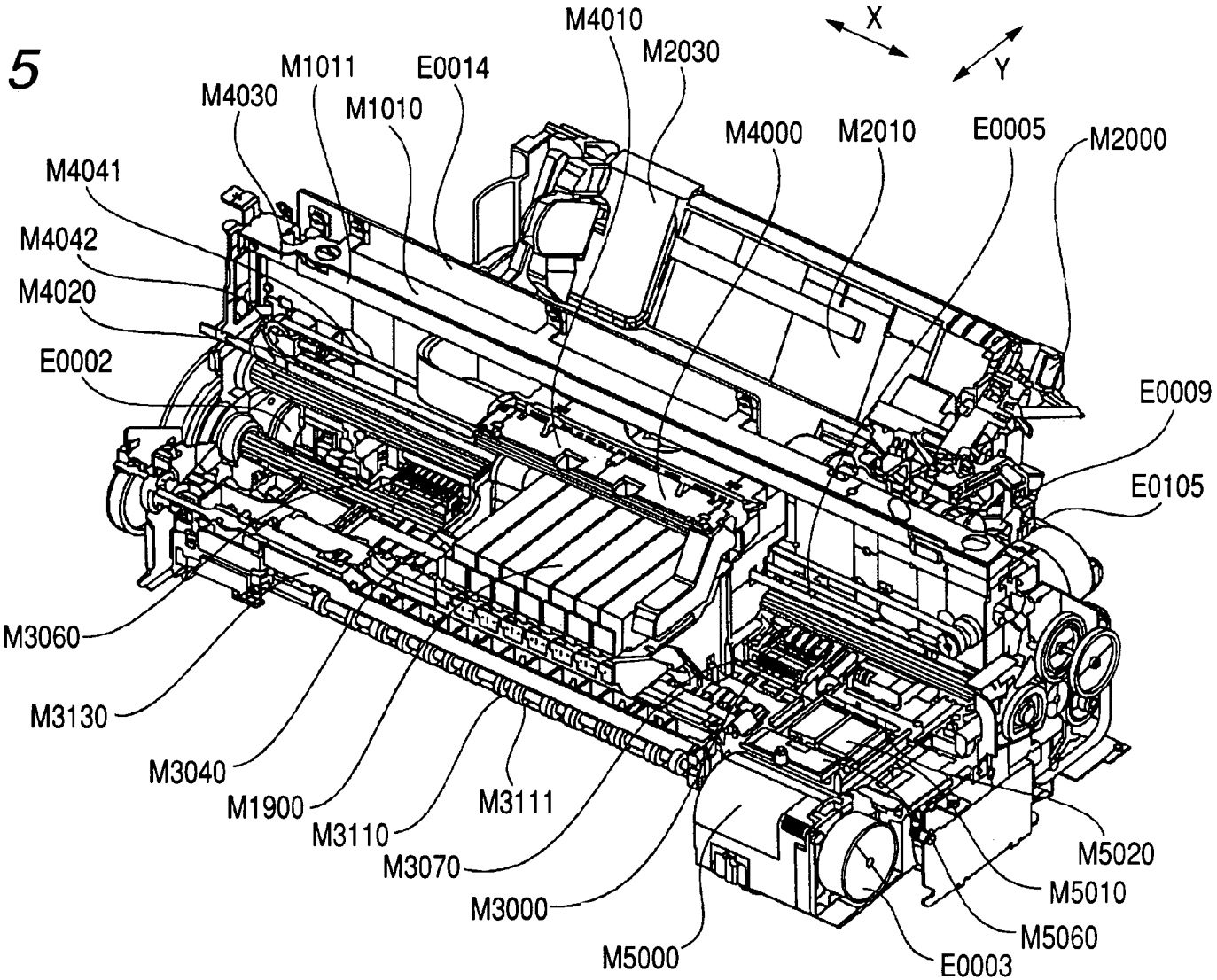
FIG. 5 is a perspective view of mechanisms of a recording apparatus constituting a first embodiment of the invention.

FIG. 5 shows the entire main body of the recording apparatus, but the explanation will be given on the cleaning portion since the present invention relates to a suction recovery operation.

(Cleaning Portion)

The cleaning portion is constituted for example of a pump M5000 for cleaning an ink jet head H1001, a cap M5001 for suppressing drying of the ink jet head H1001, and a blade M5020 for cleaning a discharge port bearing face of the ink jet head H1001.

In the cleaning portion, an exclusive cleaning motor E0003 is provided. The cleaning motor E0003 is provided with an unillustrated one-way clutch, and activates the pump in the rotation of a direction, and, in the rotation of the other direction, activates a blade M5020 and causes an up-down operation of cap M5010.

The pump M5000 is so constructed that an unillustrated pump roller strokes two unillustrated tube to generate a negative pressure. The cap M5010 is connected to the pump M5000 via an unillustrated valve. When the pump M5000 is activated in a state where the cap M5010 is maintained in contact with the ink discharge ports of the ink jet head H1001, unnecessary ink is sucked out from the ink jet head H1001. Inside the cap M5010, a cap absorbent member is provided for absorbing ink which remains on the face of the ink jet head after the suction. It is so designed that the ink remaining in the cap M5010 can be sucked in a state where the cap M5010 is opened, in order to avoid solidification of the remaining ink and the drawbacks thereafter. The ink sucked by the pump M5000 becomes waste ink which is absorbed and retained in a waste ink absorbent member provided in the lower case.

Serial operations such as the operation of the blade M5020, the up-down motion of the cap M5010 and the open-close operation of the valve are controlled by an unillustrated main cam having plural cams on a shaft. A cam or an arm in each portion is actuated by the main cam to execute predetermined operations. In a down-state of the cap M5010, the blade M5020 is moved perpendicularly to the scanning direction of the carriage M4000, thereby cleaning the face of the ink jet head H1001. The blade M5020 is provided in plural units, for the purposes of cleaning a vicinity of the nozzles of the ink jet head H1001 and cleaning the entire face. When the carriage M4000 is moved to a rearmost position, a blade cleaner M5060 is contacted whereby the ink or the like deposited on the blade M5020 itself can be removed.

(Structure of Ink Jet Head)

In the following, there will be explained a structure of the ink jet head cartridge H1000 to be employed in the present embodiment. The ink jet head cartridge H1000 includes an ink jet head H1001, means which mounts an ink tank H1900, and means which supplies ink from the ink tank H1900 to the ink jet head, and is detachably mounted on the carriage M4000.

Figure 6:
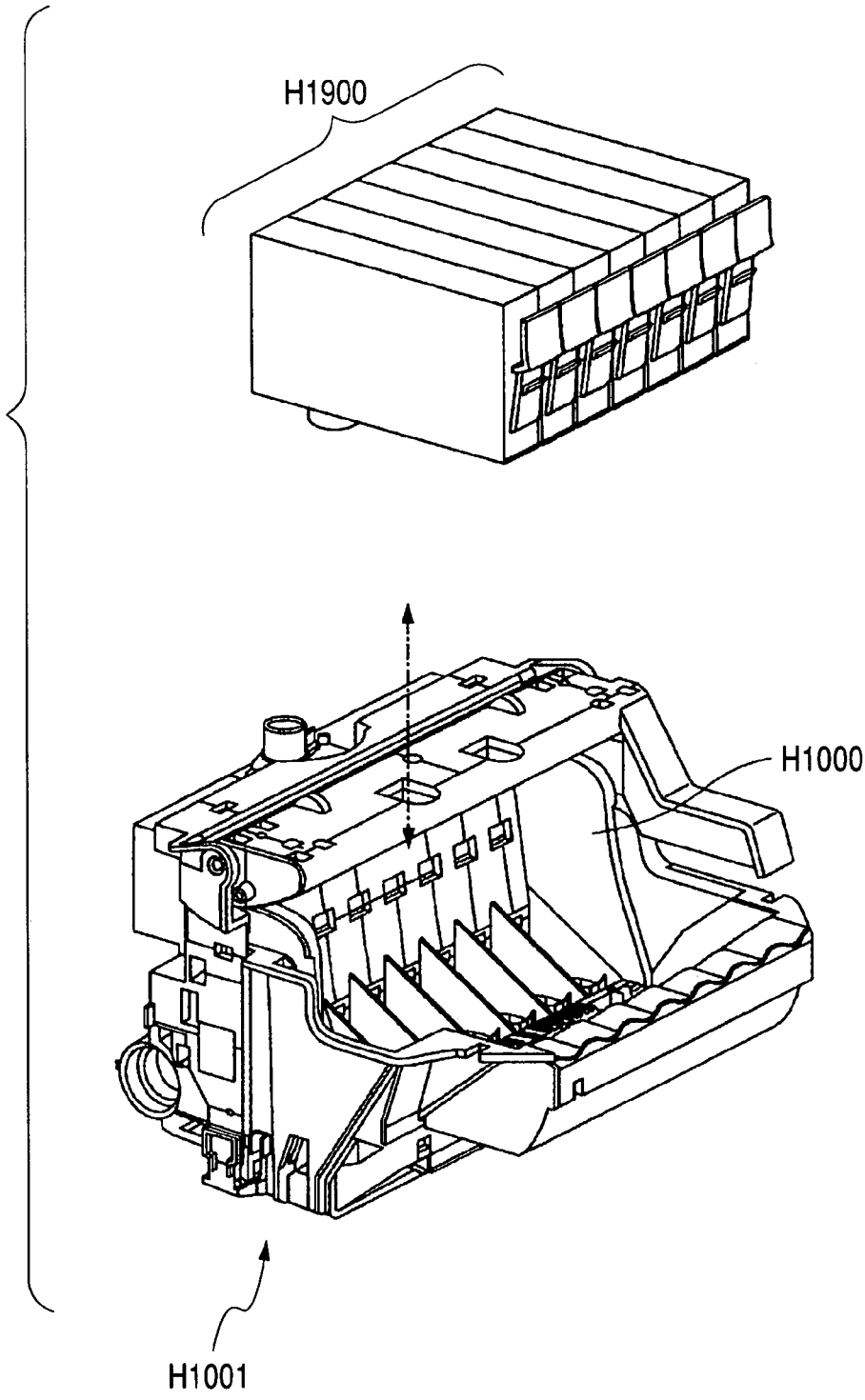
FIG. 6 is a perspective view showing a state where an ink tank is mounted on an ink jet head cartridge applied in the first embodiment of the invention.

FIG. 6 shows a mode of mounting of the ink tank H1900 on the ink jet head cartridge H1000 employable in the present embodiment. The ink jet head cartridge H1000 is to be used in a recording apparatus which forms an image by discharging inks of 7 colors, and is therefore provided with independent ink tanks H1900 for 7 colors. As illustrated, each ink tank is independently detachably mountable on the ink jet head cartridge H1000. The ink tank H1900 can be detached or mounted in a state where the ink jet head cartridge H1000 is mounted on the carriage M4000.

Figure 7:
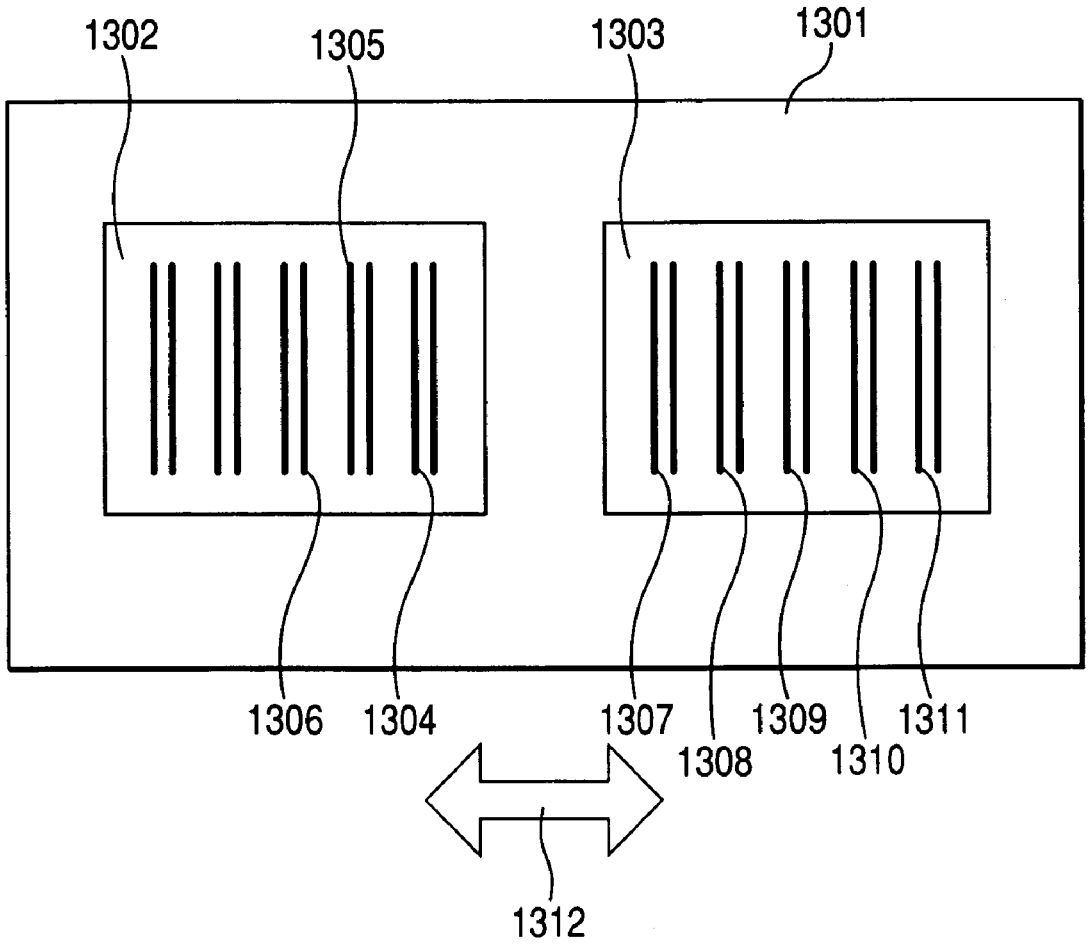
FIG. 7 is a view showing a nozzle configuration of the ink jet head constituting the first embodiment of the invention.

FIG. 7 shows a nozzle configuration of the ink jet head in the first example of the invention.

There are illustrated an ink jet head 1301, an ink jet head unit 1302 featuring a high-speed full-color recording, and an ink jet head unit 1303 featuring a high-quality full-color recording.

The ink jet head unit 1302 featuring a high-speed full-color recording includes a cyan ink, a magenta ink and a yellow ink for reproducing full-colors by a subtractive color mixing. The nozzles for discharging these inks are arranged in arrays 1304, 1305, 1306 along a direction (also called conveying direction) substantially perpendicular to a scanning direction 1312 of the ink jet head, and a pair of nozzle rows is provided for the ink of each color. Each of the nozzle arrays 1304, 1035 is provided further with a pair of nozzle rows, and the ink jet head unit 1302 featuring a high-speed full-color recording has a nozzle array 1306 and two sets of nozzle arrays 1304, 1305. Thus, in the ink jet head unit 1302, the nozzle arrays for the respective colors are provided symmetrically along the main scanning direction.

On the other hand, an ink jet head unit 1303 featuring a high-quality full-color recording is provided with nozzle arrays 1307, 1311 for discharging a light cyan ink (also called pale cyan ink) and a light magenta ink (also called pale magenta ink) for improving the gradation of the output image, and a nozzle array 1309 for discharging a black ink for increasing the contrast of the output image. Also in the present embodiment, two specific color inks (special ink 1 and special ink 2) are employed for reproducing a color range that cannot be reproduced by the colorants of three primary colors of cyan, magenta and yellow, so that the ink jet head unit 1303 is provided with nozzle arrays 1308, 1310 for discharging such two specific color inks. Also in the ink jet head unit 1303, each of the nozzle arrays 1307-1311 is constituted, as in the ink jet head unit 1302, of paired two rows.

In the ink jet head of the present embodiment, a nozzle array (also called an array of recording elements) corresponding to each different ink color is constituted of 768 nozzles arranged with a pitch of 1200 dpi (dot per inch: reference value) in the conveying direction of the recording medium, and each nozzle discharges an ink droplet of about 2 picoliters. Also the discharge port of each nozzle has an aperture area of about 100 $\mu m^2$.

(Maintenance System)

Figure 8:
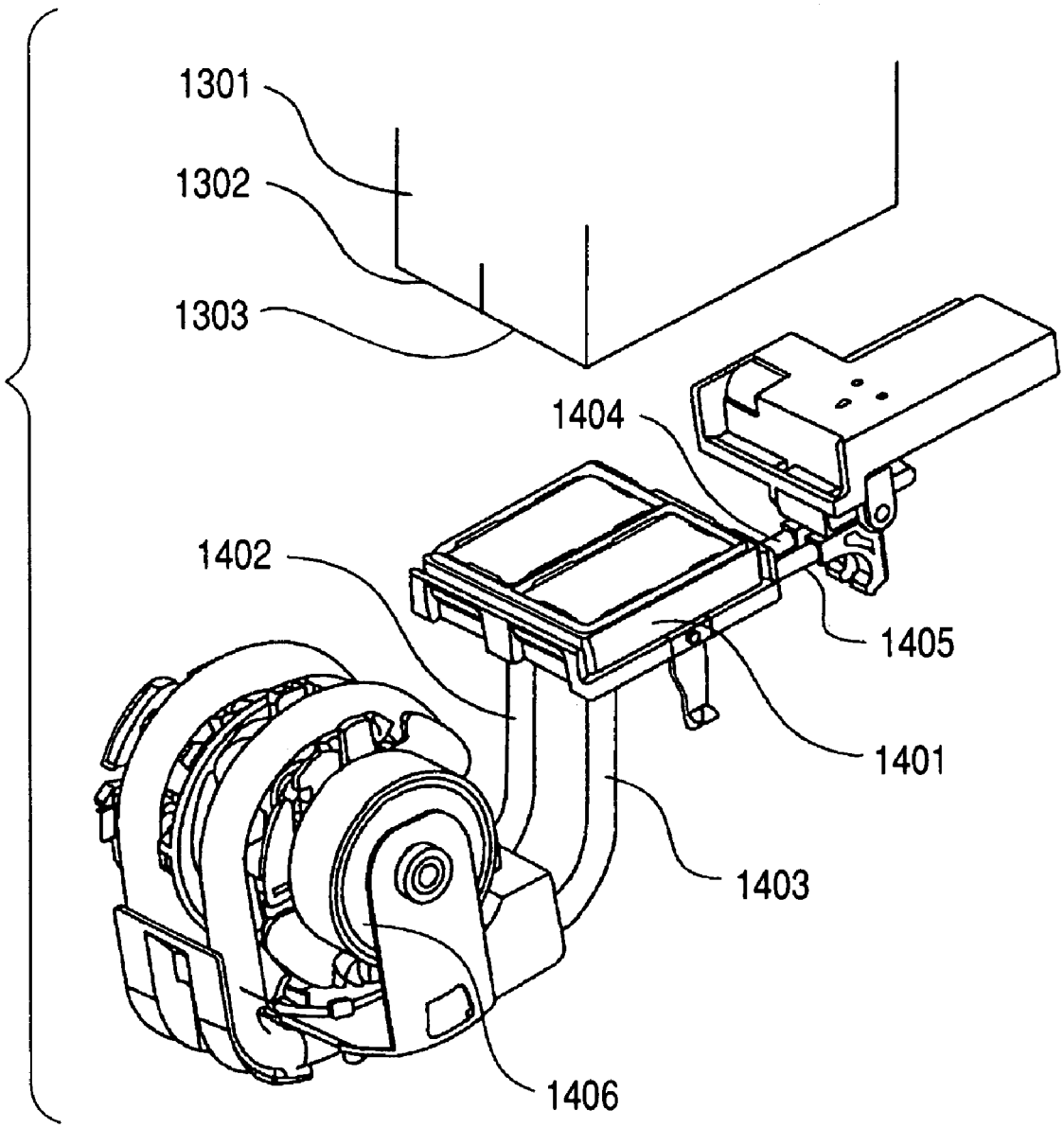
FIG. 8 is a view showing a maintenance system of the ink jet recording apparatus embodying the invention.

FIG. 8 shows a maintenance system of an ink jet recording apparatus embodying the present invention.

A suction cap 1401 has two chambers for respectively capping the ink jet head unit 1302 and the ink jet head unit 1303 and can be contacted with or pressed to nozzle bearing faces of such ink jet head units. The chambers of the suction cap 1401 are respectively provided with air valves 1404, 1405 for opening to the air, and also independently with ink discharge tubes 1402, 1403. If suction pumps are provided independently on the ink discharge tubes 1402, 1403, the maintenance system becomes bulky to increase the size and the cost of the apparatus. In the present embodiment, therefore, a suction pump 1406 is provided for the two ink discharge tubes 1402, 1403. Thus, the chambers of the suction cap 1401, the air valves 1404, 1405 and the ink discharge tubes 1402, 1403 are provided respectively corresponding to the ink jet head units, while the suction pump is provided in common. At the suction recovery operation, an ink jet head unit, on which the suction recovery operation is to be executed, can be selected by closing the air valve provided in the chamber in such ink jet head unit and opening the air valve provided in the chamber in an ink jet head unit that need not be subjected to the suction recovery.

An operation of capping the face, bearing the ink discharge ports, of the ink jet head unit 1302 with the suction cap 1401, and activating the suction pump 1406 in a state where the air valve (also called an air communicating valve) corresponding to the ink jet head unit 1302 thereby sucking the ink in the suction cap or the ink in the nozzles of the ink jet head unit 1302 is called a suction operation. Such suction operation allows to maintain a satisfactory ink discharge state from the ink jet head unit 1302. A suction operation is similarly executed also on the ink jet head unit 1303. In FIG. 8, the suction cap 1401 is so constructed as to cap both ink jet head units 1302, 1303, but there may be provided two suction caps for separate cappings.

Also changes in a rotation amount and a revolution of the suction pump allow to vary a negative pressure to the ink jet head, thereby varying a recovery amount of ink discharge from the ink jet head. The recovery amount of ink discharge from the ink jet head can also be varied by changing a time of operation of the suction pump.

(Suction Recovery Operation)

Figure 9:
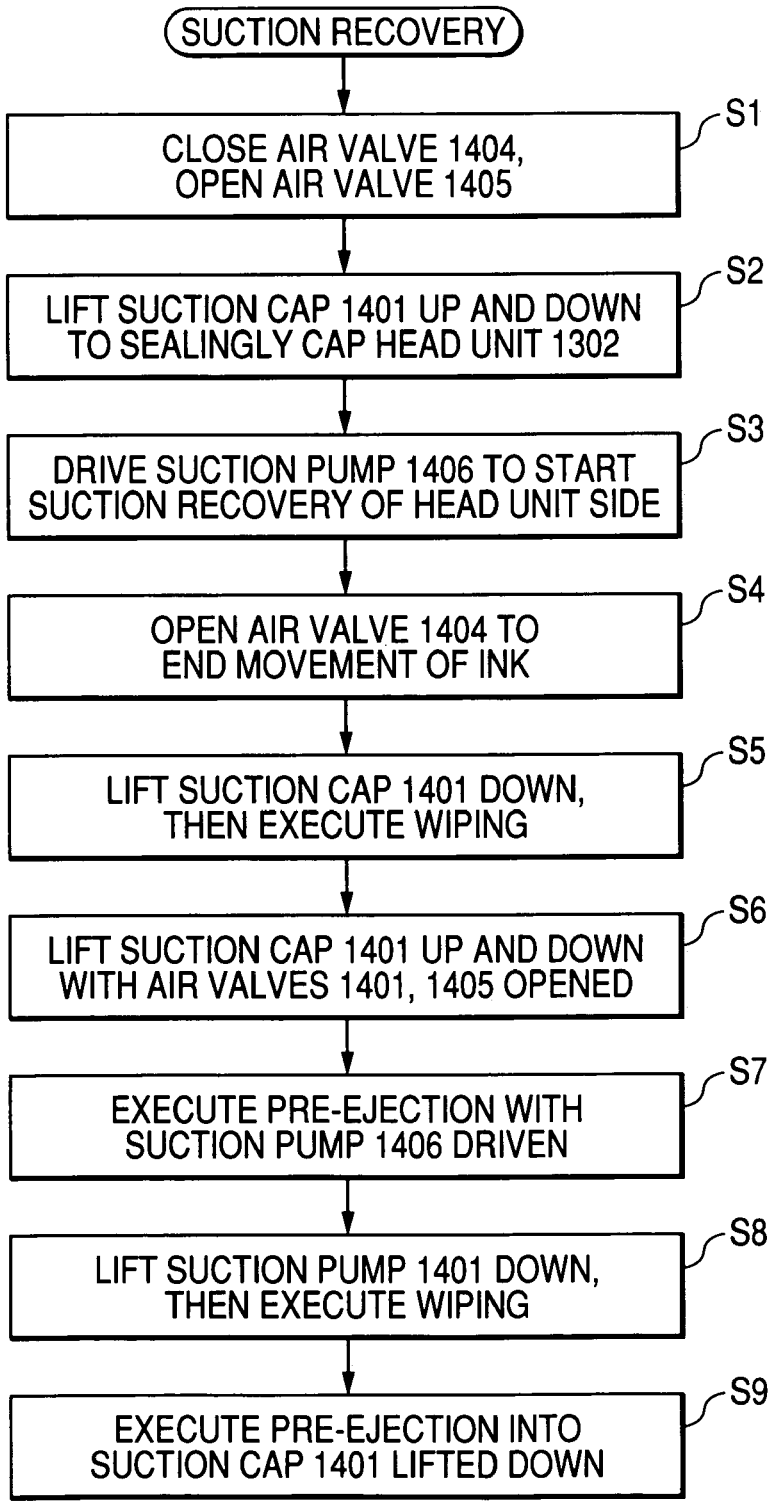
FIG. 9 is an operation sequence in case the suction recovery is to be executed by a constitution portion 30.

FIG. 9 shows an operation sequence in case of executing the suction recovery operation only on the ink jet head unit 1302.

Though not illustrated in FIG. 8, the operations of the suction cap and the like in the suction recovery operation are controlled by a rotation of the cam shaft and by a gear control.

At first, while the air valve 1404 is closed, the air valve 1405 is shifted to an open state (step 1). Then the suction cap 1401 is lifted and pressed to the ink jet head 1301, thereby capping the nozzle-bearing face thereof (step 2). The step 2 closes only the chamber of the suction cap 1401 corresponding to the ink jet head unit 1302. Then the suction pump 1406, connected to the two ink discharge tubes 1402, 1403, is activated to execute the suction recovery operation for the ink jet head unit 1302 (step 3). In this state, the chamber of the suction cap 1401 corresponding to the ink jet head unit 1303 merely inhales air through the air valve, whereby the recovery operation is not conducted in the ink jet head unit 1303, and the suction operation is executed only on the ink jet head unit 1302. A rotation amount of the suction pump is desirably changed according to the purpose of maintenance (ink amount to be sucked from the ink jet head 1301). Then, upon completion of the predetermined suction operation, the air valve 1404 is opened to introduce the air into the chamber of the suction cap, enclosing the ink jet head unit 1302, thereby terminating the ink displacement in the ink jet head 1301 (step 4). Then the suction cap 1401 is lowered to execute a wiping operation, thereby wiping off the ink droplets remaining on the surface of the ink jet head unit 1302 (step 5). Then, while both air valves 1404, 1405 are open, the suction cap 1401 is lifted (step 6). Then, in a state where the interior of the suction cap 1401 maintained in contact with the ink jet head communicates with the exterior, the suction pump 1406 is activated and a preliminary discharge is executed from the ink jet head unit 1302 (step 7). The operation of the step 7 is executed for preventing a situation that the interior of the apparatus is smeared by the ink mist generated at the preliminary discharge. Then the suction cap 1401 is again lowered to execute a wiping operation thereby wiping off the ink droplets remaining on the surface of the ink jet head unit 1302 (step 8), and a preliminary discharge is executed into the lowered suction cap 1401 (step 9) whereupon the sequence for the suction recovery is terminated.

The sequence shown in FIG. 9 shows a case of a recovery operation for the ink jet head unit 1302 featuring the high-speed full-color recording, but a recovery operation for the ink jet head unit 1303 featuring the high-quality full-color recording can be executed by opening the air valve 1404 and closing the air valve 1405 in the step 1.

The above-described operation allows to execute the suction recovery selectively on each of the ink jet head units 1302 and 1303. In case of executing the suction recovery for the ink jet head units 1302 and 1303 at the same time, the aforementioned sequence of recovery operation can be executed by closing both the air valves 1404 and 1405. Also the suction recovery operation may be so controlled as to activate the suction pump 1406 after the step 9, thereby sucking the ink in the suction cap 1401.

As explained in the foregoing, the present embodiment adopts a configuration of separating an ink jet head unit 1302 featuring the high-speed full-color recording and an ink jet head unit 1303 featuring the high-quality full-color recording in the ink jet head and enabling a suction recovery independently for each ink jet head unit, whereby a number of ink tanks (or nozzle arrays) subjected to the suction recovery at a tank exchange is reduced from total 8 colors to 5 or 3 colors, thereby reducing the ink consumption by the suction recovery.

Also in the flow chart shown in FIG. 9, the wiping operation and the preliminary discharge after the suction operation in the step 3 are executed only in the ink jet head unit subjected to the suction recovery, but, in case the suction recovery on an ink jet head unit causes a smear on the nozzle-bearing face of the other ink jet head unit, the wiping operation and the preliminary discharge after the suction operation may be executed on both ink jet head units.

First Embodiment

Figure 10:
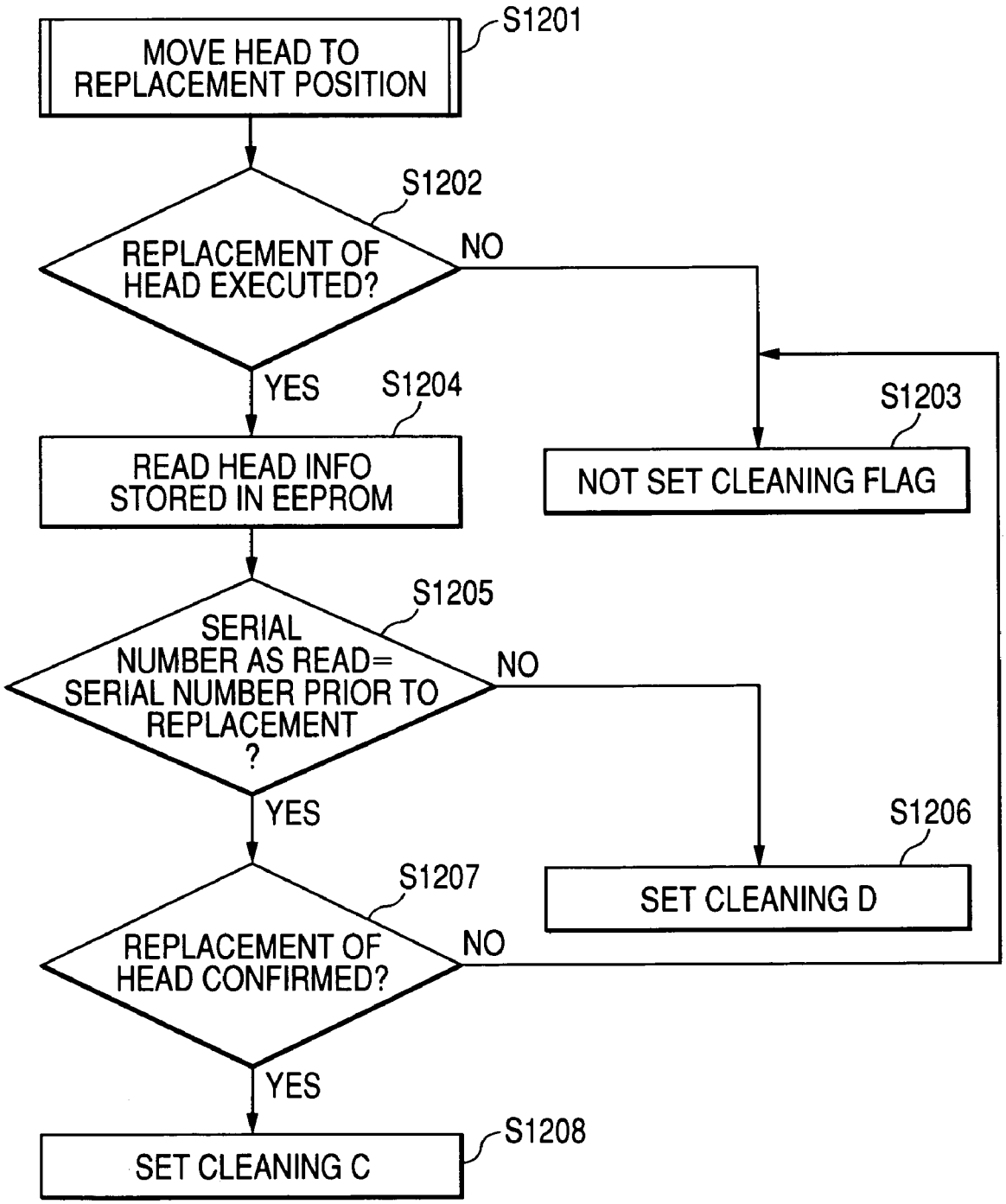
FIG. 10 is a flow chart showing a first example of the invention.

Now, most characteristic features of the first embodiment of the invention will be explained with reference to a flow chart in FIG. 10. In the present embodiment, an operation of detaching the ink jet head and the ink tank, mounted on the carriage, and mounting them again on the carriage is called a replacement. Among such replacement, a case where the initially mounted ink jet head is different from the ink jet head mounted later is called an exchange.

A step S1201 executes a displacement to a position in which an exchange or a replacement of the ink jet head and the ink tank can be executed. This step S1201 starts the displacement of the carriage supporting the ink jet head and the ink tank, in response to a detection that a cover in an upper portion of the recording apparatus is opened. Then a step S1202 discriminates whether the ink jet head is detached from the carriage. Whether the ink jet head is detached from the carriage can be easily detected by monitoring a current supply (or electric conduction) state to the ink jet head, as the current supply is interrupted at the detachment. It is possible to securely detect whether the ink jet head is detached, by repeating the discrimination of the step S1202 at a predetermined interval after the carriage is displaced to an exchange position for the ink jet head and the ink tank. Upon a detection that the ink jet head is mounted again on the carriage, a replacement of the ink jet head is judged. In case the step S1202 identifies that the ink jet head is not detached from the carriage (not replaced), no suction recovery is required and a cleaning flag for instructing the execution of a suction recovery is not set in an EEPROM of the recording apparatus (step S1203).

In case the step S1202 identifies that the ink jet head is detached (replaced) from the carriage, there is acquired information concerning the ink jet head, stored in an EEPROM equipped in the ink jet head mounted on the carriage (step S1204). In particular, the step S1204 acquires information corresponding to a serial number specific to the ink jet head. Then, in order to discriminate whether the ink jet head after the replacement is different from the ink jet head prior to the replacement, namely whether the ink jet head has been exchanged, a step S1205 compares the serial number of the ink jet head, in the information acquired in the step S1204, with the serial number of the ink jet head prior to the detachment, recorded in the EEPROM of the recording apparatus. Such serial number is capable of identifying individual ink jet head. In case the step S1205 identifies that the result is different, it is considered that the ink jet head is exchanged with a new ink jet head, and an execution flag for a cleaning D is set in the EEPROM of the recording apparatus in order to execute a recovery operation of a recovery amount optimum for a new ink jet head (step S1206).

In case the step S1205 identifies that the comparison shows a coinciding result, there is confirmed again whether the ink jet head has been replaced (step S1207). In case the step S1207 identifies that the ink jet head has not been replaced (discrimination in the step S1202 being wrong), the sequence proceeds to a step S1203 and a cleaning flag is not set in the EEPROM. Also, in case the step S1207 identifies that the ink jet head has been replaced (discrimination in the step S1202 being correct), the ink jet head has not been exchanged but has merely been replaced, so that an execution flag for a cleaning C is set in the EEPROM of the recording apparatus in order to execute a recovery operation of a recovery amount different from that in the recovery operation at an exchange of the ink jet head (S1208). The cleaning D, executed after an exchange of the ink jet head, has a recovery amount larger than that of the cleaning C, executed after a replacement of the ink jet head. Also the cleaning C has a recovery amount larger than that of a recovery operation executed at a predetermined timing when the ink jet head is not replaced.

In case any flag is set finally, a corresponding recovery operation is executed at an appropriate timing thereafter. Such timing for executing the recovery operation can be, for example, when the power supply for the recording apparatus is turned on, when recording data are received or recorded, or when a time elapsing from the preceding recovery operation exceeds a predetermined period.

As explained in the foregoing, the present embodiment executes a control, in response to a detection of an exchange or a replacement of the ink jet head, for conducting a recovery operation with different recovery amounts corresponding to such operations, thereby avoiding defective ink supply and suppressing a wasted ink consumption by unnecessarily many recovery operations. Also the recovery operations, not executed unnecessarily many times, allow to reduce the waste ink amount, thereby reducing the size of the waste ink absorbent member and the dimension of the main body of the recording apparatus.

In the present embodiment, in case the EEPROM can store plural serial numbers for the ink jet head, an exchange to a new ink jet head can be identified when the step S1205 identifies that the serial number acquired in the step S1204 is different from the plural serial numbers stored in the EEPROM. Thus, even in a recording apparatus capable of accepting ink jet heads of different types, such configuration allows to execute a recovery operation of the cleaning D with a large recovery amount for a new ink jet head and a recovery operation of the cleaning C with a small recovery amount for an ink jet head that has been exchanged but has been used before, thereby achieving an appropriate recovery operation not wasting the ink.

Second Embodiment

In the first embodiment, a serial number of an ink jet head is stored in a memory of the recording apparatus for discriminating whether the ink jet head has been exchanged or replaced. In contrast, the second embodiment is characterized in storing, in a memory provided in the ink jet head, information indicating whether the ink jet head is new, and such information is used for discriminating whether the ink jet head has been exchanged or replaced.

Figure 11:
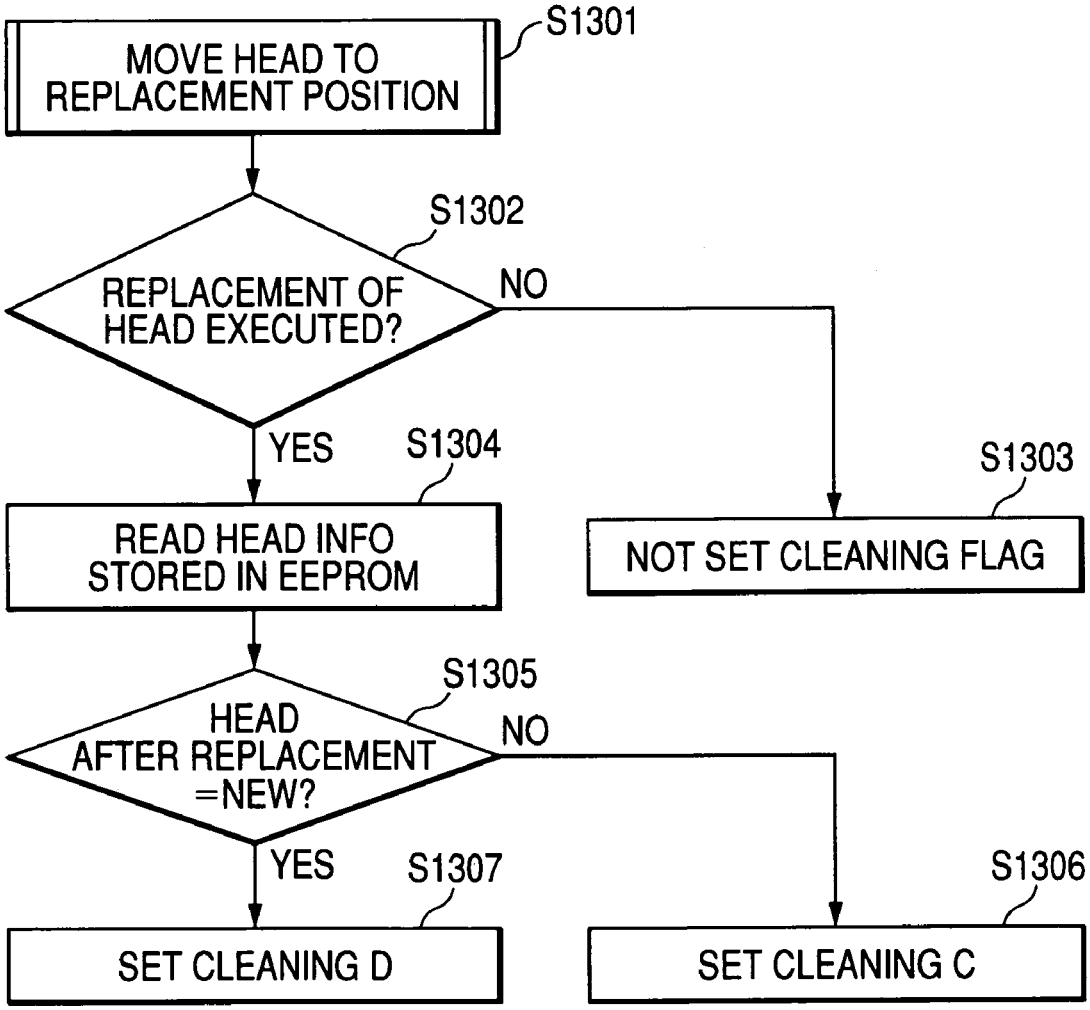
FIG. 11 is a flow chart showing a second example of the invention.

In the following, the second embodiment of the invention will be explained with reference to a flow chart shown in FIG. 11.

In the second embodiment, an EEPROM equipped in the ink jet head has a description allowing to discriminate whether the ink jet head is new. A step S1301 executes a displacement to a position in which an exchange or a replacement of the ink jet head and the ink tank can be executed. Then a step S1302 discriminates whether the ink jet head is detached from the carriage. This can be easily detected by monitoring a current supply state to the ink jet head, as the current supply is interrupted at the detachment. In case it is identified that the ink jet head is not replaced, no suction recovery is required and a cleaning flag for instructing the execution of a suction recovery is not set in an EEPROM of the recording apparatus (step S1303). In case it is identified that the ink jet head is replaced, there is acquired information of an EEPROM equipped in the ink jet head mounted on the carriage after the replacement (step S1304). A step S1305 discriminates, based on the acquired EEPROM information, whether the ink jet head after the replacement is new. In case of an identification that it is not a new ink jet head, an execution flag for a cleaning C is set in the EEPROM of the recording apparatus in order to execute a recovery operation of a recovery amount different from that in the recovery operation for a new ink jet head (S1306). In case of an identification of a new ink jet head, an execution flag for a cleaning D is set in the EEPROM of the recording apparatus in order to execute a recovery operation of a recovery amount optimum for a new ink jet head (S1307). Also in case of executing the recovery operation of cleaning D, the information (flag) in the EEPROM, indicating a new ink jet head, is changed to information indicating that it is not new.

In case any flag is set finally, a corresponding recovery operation is executed at an appropriate timing thereafter.

As explained in the foregoing, also in this embodiment, it is possible to detect that the ink jet head is exchanged to a new one or it is replaced, and to control the recovery operation with different recovery amounts corresponding to such operations, thereby avoiding defective ink supply and suppressing a wasted ink consumption by unnecessarily many recovery operations. Also it is rendered possible to reduce the waste ink amount, thereby reducing the size of the waste ink absorbent member and the dimension of the main body of the recording apparatus.

By storing information indicating whether the ink jet head is new in the EEPROM equipped in the ink jet head, it is rendered possible to securely know whether the used recording head is new or not, and to execute the recovery operation more appropriately. Also in case an ink jet head is used on plural recording apparatuses, it is possible to correctly identify whether the used ink jet head is new or not, so that the recovery operation can be executed in an appropriate manner.

This application claims priority from Japanese Patent Application No. 2004-030830 filed on Feb. 6, 2004, which is hereby incorporated by reference herein.

What is claimed is:

1. An ink jet recording apparatus capable of mounting selectively on a carriage plural ink jet heads for discharging ink, and executing a recording operation by scanning the carriage, comprising:

recovery means which maintains a satisfactory ink discharge state from the ink jet head;

detection means which detects whether the ink jet head is mounted on the carriage;

judgment means which judges whether the ink jet head newly mounted on the carriage is different from the ink jet head mounted previously on the carriage, after the detection means detects that the ink head has been dismounted from the carriage; and recovery control means which controls a recovery operation for the ink jet head by the recovery means according to results of the detection means and the judgment means, wherein the recovery control means differentiates a recovery operation when the newly mounted ink jet head is same as the previously mounted ink jet head and a recovery operation when the newly mounted ink jet head is different from the previously mounted ink jet head, wherein the recovery control means differentiates a recovery operation when the newly mounted ink jet head is same as the previously mounted ink jet head and a recovery operation when the ink jet head is not detached from the carriage, and wherein the recovery control means executes a recovery operation of a larger amount when the newly mounted ink jet head is same as the previously mounted ink jet head in comparison with a recovery operation executed when the ink jet head is not detached from the carriage.

2. An ink jet recording apparatus capable of mounting selectively on a carriage plural ink jet heads for discharging ink, and executing a recording operation by scanning the carriage, comprising:

recovery means which maintains a satisfactory ink discharge state from the ink jet head;

detection means which detects whether the ink jet head is mounted on the carriage;

judgment means which judges whether the ink jet head newly mounted on the carriage is different from the ink jet head mounted previously on the carriage; and recovery control means which controls a recovery operation for the ink jet head by the recovery means according to results of the detection means and the judgment means, wherein the recovery control means differentiates a recovery operation when the newly mounted ink jet head is same as the previously mounted ink jet head and a recovery operation when the ink jet head is not detached from the carriage, and wherein the recovery control means executes a recovery operation of a larger amount when the newly mounted ink jet head is same as the previously mounted ink jet head in comparison with a recovery operation executed when the ink jet head is not detached from the carriage.

* * * * *

UNITED STATES PATENT AND TRADEMARK OFFICE

CERTIFICATE OF CORRECTION

PATENT NO. : 7,354,133 B2
APPLICATION NO. : 11/045108
DATED : April 8, 2008
INVENTOR(S) : Ide et al.

It is certified that error appears in the above-identified patent and that said Letters Patent is hereby corrected as shown below:

COLUMN 11:
Line 48, “ink head” should read --ink jet head--.

Signed and Sealed this

Tenth Day of March, 2009

JOHN DOLL
*Acting Director of the United States Patent and Trademark Office*